United States Patent [19]

Gerndt et al.

[11] Patent Number: 4,458,578

[45] Date of Patent: Jul. 10, 1984

[54] TRIGGER FOR AN AUTOMATIC FIREARM HAVING A LINEAR ACTION BREECH BLOCK

[75] Inventors: Edgar Gerndt, Düsseldorf; Günter Frye, Erkrath, both of Fed. Rep. of Germany

[73] Assignee: Rheinmetall GmbH, Düsseldorf, Fed. Rep. of Germany

[21] Appl. No.: 344,073

[22] Filed: Jan. 28, 1982

[30] Foreign Application Priority Data

Feb. 5, 1981 [DE] Fed. Rep. of Germany ..... 3103864

[51] Int. Cl.[3] ..... F41D 11/02

[52] U.S. Cl. ..... 89/136; 89/132; 89/145; 42/69 A

[58] Field of Search ..... 89/132, 136, 144, 145, 89/149, 150, 153, 194; 42/69 A

[56] References Cited

FOREIGN PATENT DOCUMENTS

| | | | |
|---|---|---|---|
| 65509 | 8/1947 | Denmark | 42/69 A |
| 66893 | 3/1948 | Denmark | 89/132 |
| 2511765 | 9/1976 | Fed. Rep. of Germany | 89/132 |
| 75594 | 6/1961 | France | 42/69 A |
| 1154234 | 6/1969 | United Kingdom | 89/132 |

*Primary Examiner*—Donald G. Kelly

*Attorney, Agent, or Firm*—Spencer & Frank

[57] ABSTRACT

A trigger device for an automatic firearm having a linear action breech block. The device includes a catch lever movable to arrest movement of the breech block and a specially constructed kinematic chain which prevents the occurrence of an ambiguous intermediate position of the catch lever which could allow the breech block to damage the catch lever and/or linkage elements connected thereto.

4 Claims, 4 Drawing Figures

TRIGGER FOR AN AUTOMATIC FIREARM HAVING A LINEAR ACTION BREECH BLOCK

BACKGROUND OF THE INVENTION

The present invention relates to a trigger device for an automatic firearm having a linear action breech block of the type disclosed in German Auslegeschrift [Published Patent Application] No. 2,511,765.

A drawback of such a trigger device is that an ambiguous intermediate state is possible as soon as a secondary actuator, or input, of the kinematic chain is activated at a point in time at which the control face of the breech block on its return movement has already passed a critical distance beyond the control lever. It then requires only a slight shock, which cannot be completely prevented under operating conditions, to move the catch lever into the path of movement of the breech block so that the latter, when it again returns, abuts at full speed on the upper face of the catch lever, thus causing damage.

SUMMARY OF THE INVENTION

It is an object of the present invention to provide a trigger device of the above-mentioned type in which only unequivocal states are possible.

Another object is to assure that the breech block can be caught only if its catch shoulder fully abuts on the catch face of the catch lever.

The above and other objects are achieved, according to the invention, in a trigger device for an automatic firearm equipped with a linearly displaceable breech block provided with a catch shoulder and a control face arranged to cooperate with the trigger device, the trigger device including a housing, and means defining a kinematic chain provided with a primary actuation input and a secondary actuation input, the kinematic chain including a release lever arranged to be movable between a retracted position in which it is clear of the path of movement of the control face and an actuating position in which it can be displaced by the control face to provide at least part of the secondary actuation input, a catch lever constituting the output of the chain and movable between a catch position in which it can engage the catch shoulder and a retracted position in which it permits free linear displacement of the breech block, a trigger lever movable between an inactive position and a firing position and having a plurality of arms, with a first one of the arms providing the primary actuating input for the chain and being arranged to be acted upon by a trigger table for moving the trigger lever from its inactive position to its firing position, a trigger spring associated with the trigger lever for urging it into its inactive position, with the first arm projecting out of the housing, a lower setting lever arranged to cooperate with the trigger lever, a first reset spring associated with the lower setting lever for urging it into a reference position, and means defining pivot bearings for pivotal movement of the release lever, catch lever, trigger lever and lower setting lever about axes transverse to the direction of linear displacement of the breech block, with the pivot bearing for the release lever being movable relative to the housing, the release lever being movable into its retracted position in response to movement of the trigger lever into its firing position and being movable into its actuating position in response to movement of the trigger lever into its inactive position, and the kinematic chain being operative for moving the catch lever into its retracted position exclusively by movement of the trigger lever into its firing position and for moving the catch lever from its retracted position into its catch position upon return of the trigger lever into its inactive position and subsequent actuation of the release lever by the breech block control face, in that:

the chain further comprises a holding lever mounted in the housing for pivotal movement about an axis transverse to the direction of linear displacement of the breech block and carrying the pivot bearing for the release lever, a holding spring associated with the holding lever for urging it into a normal position, and a second reset spring associated with the release lever for urging the release lever into its actuating position;

the release lever is provided with a control projection and the trigger lever is provided with a control cam disposed for cooperating with the control projection for moving the release lever into its retracted position in response to movement of the trigger lever into its firing position;

the holding lever presents a tongue positioned for engaging the catch lever and arresting the catch lever in a first intermediate position between its the catch position and retracted position during movement of the catch lever from its retracted position at a time when the holding lever is in its normal position;

the catch lever is provided, at the end thereof remote from its associated pivot axis, with a concave face disposed for effecting a deflecting contact with the lower setting lever when the catch lever is in a second intermediate position between its catch position and retracted position; and the release lever is operatively associated with the holding lever such that displacement of the release lever by the breech block control face moves the holding lever away from its normal position to an extent sufficient to move the holding lever tongue out of a position in which it can engage the catch lever, to release the catch lever from its first intermediate position.

As a result, the best possible conditions exist in the trigger area for reliable operation of a weapon equipped with the present invention.

DESCRIPTION OF THE PREFERRED EMBODIMENTS

Figure 1:
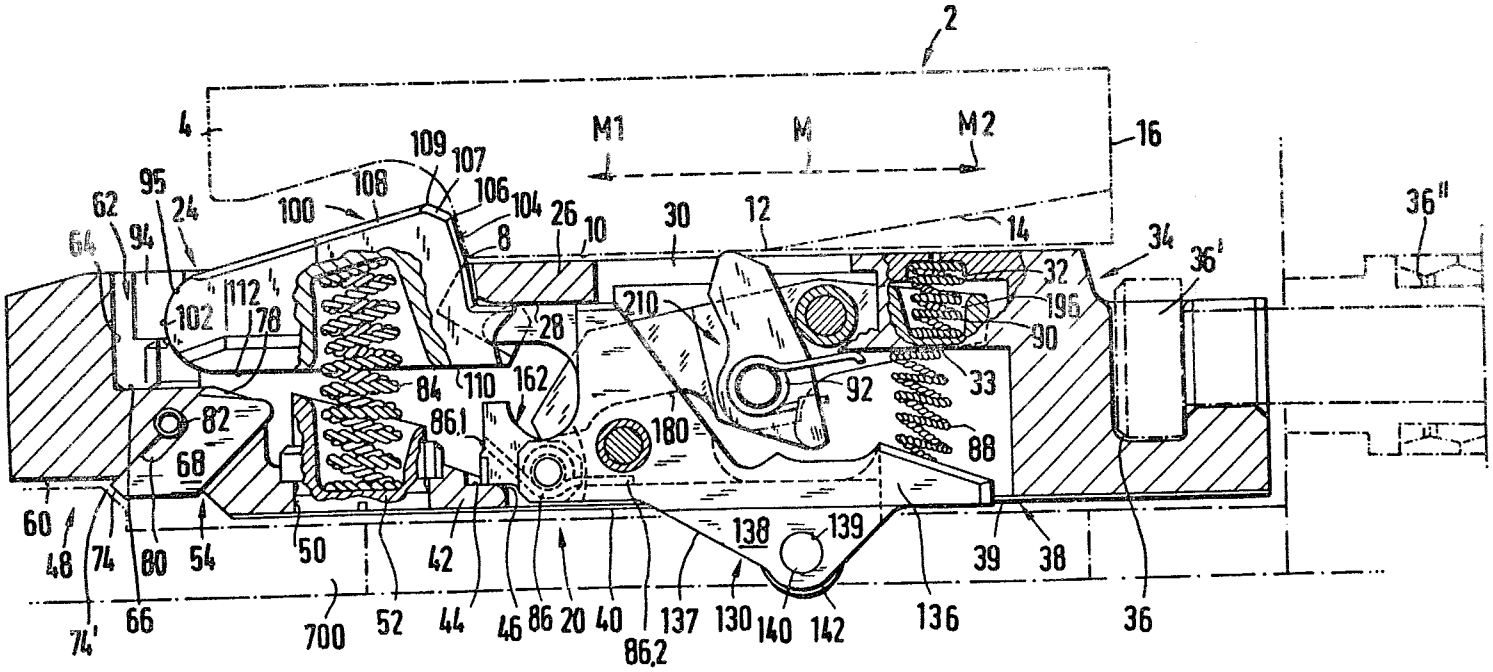
FIGS. 1 through 4 are identical longitudinal cross-sectional views of a preferred embodiment of the invention in different operational states.

Referring to the Figures, the trigger device according to the invention is disposed in a housing 20 below the path of movement M of a movable element 2 of a linear action breech block. The housing 20 is provided in its frontal region 48 with a receptacle 62 for a pressure member 94 and at its top 22 with a front opening 24 for a catch lever 100 and a rear opening 30 for a release lever 210. Between the two openings 24 and 30 there is disposed a bridge 26.

Figure 2:
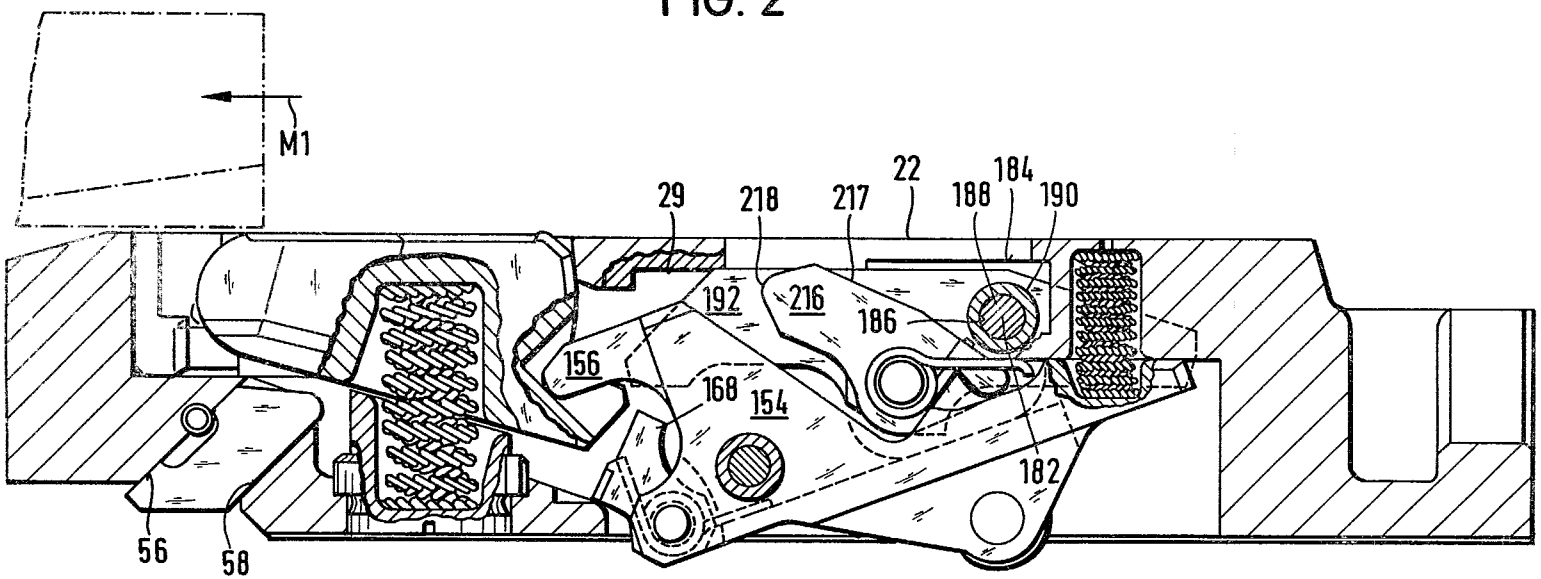

In the area to the rear of the opening 30, transversely to the path of movement M, a bearing bolt 188, identified in FIG. 2, for pivotally supporting a holding lever 180 extends along an axis 182. In the front region of the opening 30, in the vicinity of the underside 38 of housing 20, transversely to the path of movement M, a bearing bolt 133, identified in FIG. 3, for pivotally supporting a trigger lever 130 extends along an axis 132. Directly in front of the axis 132 an abutment face 44 extends transversely to the path of movement M, and in front of face 44 there is provided a recess 50 housing a spring bearing 52. The rear boundary of abutment face 44 is defined by a control edge 46.

Between edge 46 and a lower edge 39, an opening 40 for the trigger lever 130 is provided at the underside 38 of the housing 20. The two ends of bearing 133 and 188 are fixed in respective ones of the two sidewalls of the housing 20. These sidewalls extend parallel to the plane of each Figure and are not shown and identified in detail. In the vicinity of the rear end of the opening 30 at the top of housing 20, a spring bearing 32 is provided.

The catch lever 100 is provided with a frontal bearing face 102 which establishes a pivot bearing with a mating concave surface 95 of the pressure member 94. The lever 100 further presents a rear side catch face 104, an upper side control face 108, and an intermediate face 107 between faces 104 and 108. Below the catch face 104, lever 100 is provided with a control recess 116, identified in FIG. 4, which does not extend across the entire width of the lever and is not visible in the plane of the Figures. A recess 114, identified in FIG. 3, for a catch spring 84 is disposed between a rear face 110 and a front face 112 of the underside of lever 100.

Figure 3:
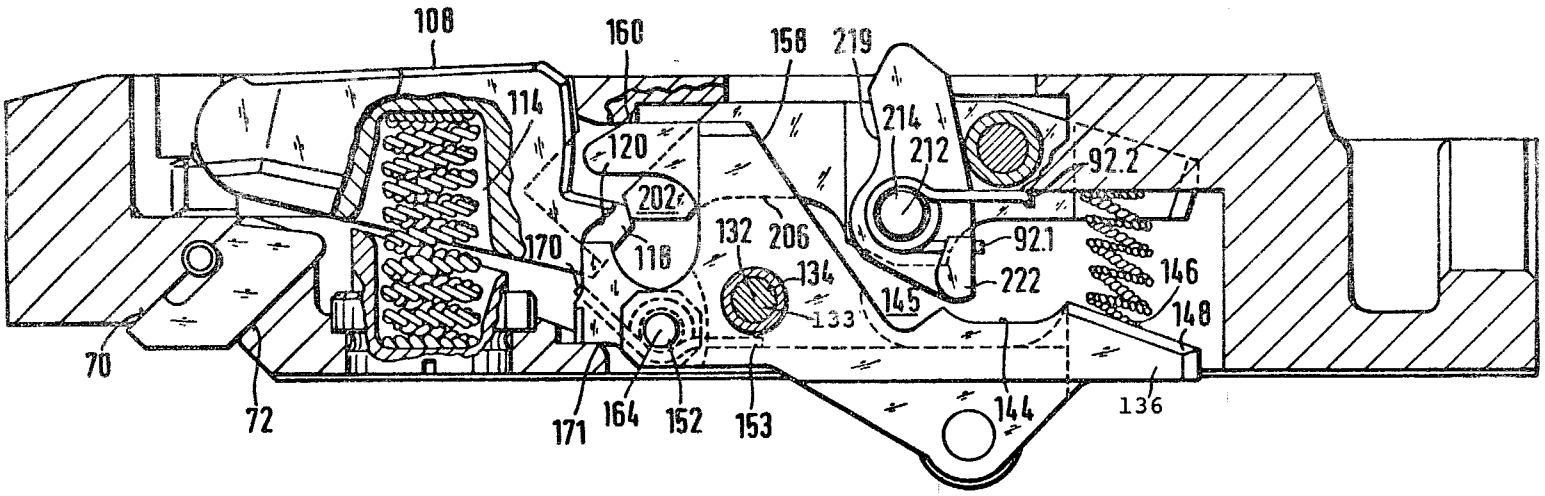

The trigger lever 130 is equipped with a bearing bush 134, identified in FIG. 3, for bearing bolt 133, and an arm 154, identified in FIG. 2, which extends upwardly beyond the bearing bush 134 in the direction of the top 22 of the housing 20. Arm 154 carries a control tongue 156 which is oriented toward the control recess 116 of the catch lever 100 and which presents an upper edge 160, identified in FIG. 3. Edge 160 is followed at the top by a rear face 158 which includes a recess 145 and a control cam 144 extending along an arm 136 and ending in a spring bearing 146 and a rear abutment face 148. In the region of the underside 137 of the arm 136, identified in FIG. 1, the trigger lever 130 is provided with a fork-, or yoke-shaped bearing member 138 presenting bearing 139 receiving the ends of a bearing bolt 140 carrying a control roller 142.

A third, frontal, arm 150 of the trigger lever 130, identified in FIG. 4, normally extends horizontally and is provided, below the control tongue 156, with a bearing bush 166 accommodating a bearing bolt 152, identified in FIG. 3, supporting a one-armed lower setting lever 162, identified in FIG. 1, having a pivot axis 164, identified in FIG. 3, which is transverse to the path of movement M. In the region of the bearing bolt 152 there is disposed a reset spring 86, identified in FIG. 1. The lower setting lever 162 is limited at its upper end by a lower setting face 172, identified in FIG. 4, which corresponds with a counterface in the form of the rear side underside face 110 of the catch lever 100.

Figure 4:
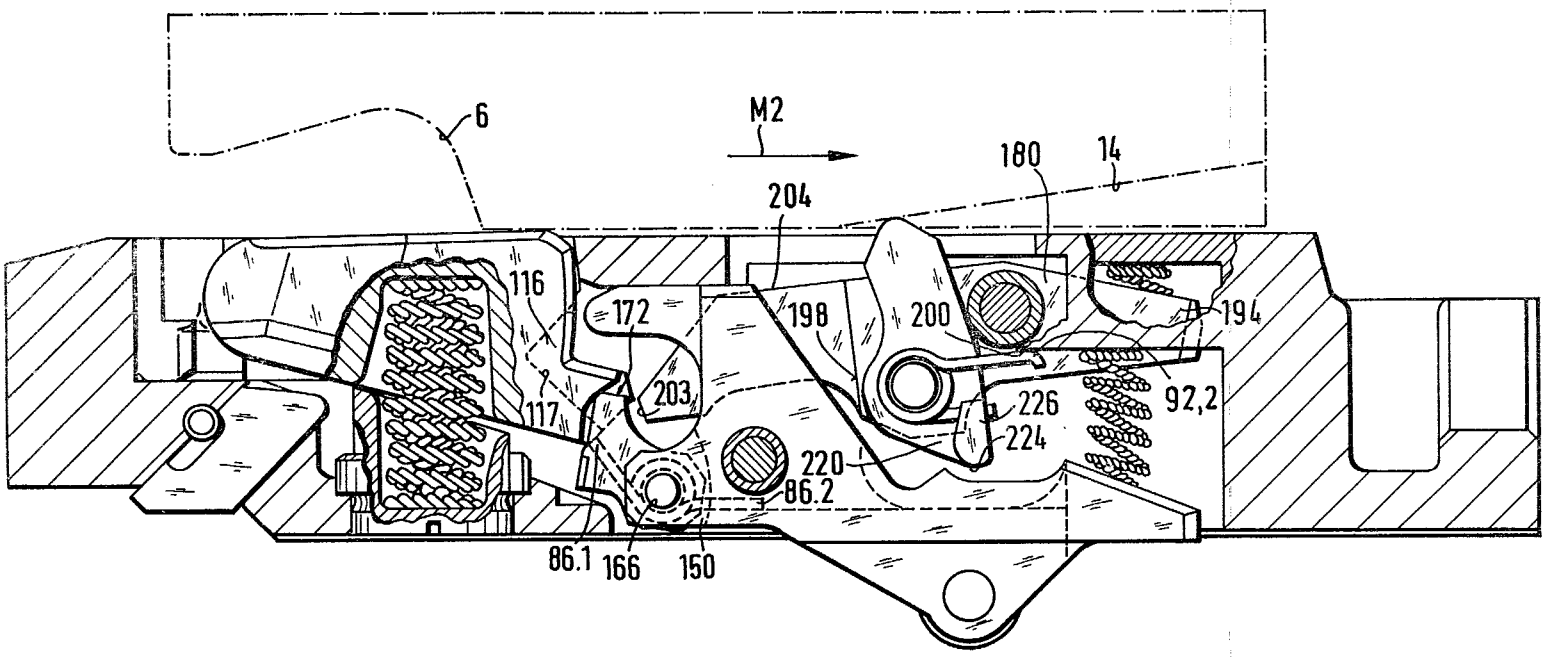

As indicated in FIGS. 2 and 4, the two-armed holding lever 180 is provided with a bearing bush 190 having a bearing opening 186 for the bearing bolt 188. The front arm 192 of lever 180, identified in FIG. 2, ends in a holding tongue 202, identified in FIG. 3, having an upper edge 204 and a detent face 203, identified in FIG. 4. In a supporting region 198 of lever 180, and in the vicinity of the front of the bearing bolt 188, there is disposed a bearing bolt 214, identified in FIG. 3, for supporting the release lever 210. The rear arm 194 of the holding lever 180 has an upwardly open spring bearing 196, identified in FIG. 1, which is associated with the spring bearing 32 in that a holding spring 90 is accommodated in bearing 196 and is compressed between that bearing and bearing 32. The resetting force produced by this holding spring 90 urges holding lever 180 in a clockwise direction.

The release lever 210 is arranged so that, if it is deflected counterclockwise, this occurs against the resetting force of a release spring 92, identified in FIG. 1, and about an axis 212, identified in FIG. 3, which is transverse to the path of movement M. A first arm 216 of lever 210, with a tongue 218, identified in FIG. 2, in the position shown in FIG. 1, is oriented essentially perpendicularly to the path of movement M. A second arm 220, identified in FIG. 4, has a lateral control projection 222, identified in FIG. 3, and a control face 224. The latter corresponds with the outline of control cam 144 of the trigger lever 130. In the upper region of the control projection 222, a spring bearing 226, identified in FIG. 4, is provided for the first arm 92.1 of the release spring 92, while the second arm 92.2 of spring 92 is supported at a point 200 forming part of a downwardly facing surface 33, identified in FIG. 1, provided by housing 20 in the vicinity of the rear part of opening 30. The one rear face 217 of the release lever 210, identified in FIG. 2, rests against a circumferential face of the bush 190.

In the front region 48 of the housing 20, a control opening 54, identified in FIG. 1, with guide faces 56 and 58, identified in FIG. 2, is provided to receive a control bolt 68 presenting counterfaces 70 and 72, identified in FIG 3, a lower control tongue 74 and an upper active face 78, identified in FIG. 1. The control tongue 74 corresponds with the face 74' of a weapon housing 700 to which the housing 20 is releasably fastened in a manner not shown. A recess 36 in the rear portion 34 of the housing 20 serves to form-lockingly accommodate the front end 36' of a conventional buffer spring 36''.

FIG. 1 shows the trigger device and the breech block 2, which is shown in dot-dash lines, in the caught position. A locking spring arrangement 36'' presses the catch shoulder 6 of the breech block 2, identified in FIG. 4, against the catch face 104 of the catch lever 100. The tongue 218 of the release lever 210 rests against the horizontal bottom face 10 of the breech block 2 and its rear face 217 rests against the circumferential face of the bush 190. The holding lever 180 is in the illustrated deflected position with the holding spring 90 compressed. The counterface 171 of the lower setting lever 162 facing away from the lower setting face 172 rests on the abutment face 44. The lower setting spring 86, which is designed as a bending spring, has its first arm 86.1 resting against a spring bearing 170 (FIG. 3) of the lower setting lever 162 and its second arm 86.2 resting against a spring bearing 153 (FIG. 3) of the trigger lever 130.

To fire a shot, a trigger table (not shown) on the side of the gun mount is moved upwardly against the control roller 142 in such a way that the trigger lever 130 is deflected counterclockwise against the force of trigger spring 88, until its rear abutment face 148 comes to lie against the surface 33 on the housing. Each of faces 148 and 33 encloses a spring abutment receptacle for a respective end of spring 88, as shown in FIG. 2.

This causes the following other procedures to take place: the control tongue 156 at arm 154 of the trigger lever 130 presses onto control abutment 117 in the control recess 116 of the catch lever 100 and pivots the latter clockwise downwardly into the housing 20; the deflecting movement of the horizontal arm 150 of the trigger lever 130 causes the lower setting spring 86 to be tensioned in that the lower setting lever 162 is deflected clockwise by the control edge 46; the control cam 144 presses against the control face 224 at the control projection 222 of the release lever 210 and pivots lever 210 counterclockwise in such a manner that the lower part of one frontal face 219 of lever 210 enters into the recess 145 and the tongue 218 moves away from the lower face 10 of the breech block 2; and one edge 109 of the catch lever 100 passes the lower edge 8 of the breech block catch shoulder 6 and the breech block 2 is accelerated in the direction of the movement arrow M1 under the force of the locking spring arrangement. The holding lever 180 is able to move clockwise, under the urging of spring 90, and its upper face 204 can rest against a downwardly directed face 29 at the top of the housing.

The trigger device is now in the state shown in FIG. 2, in the firing position, and remains in this position as long as the trigger table on the gun mount holds the trigger lever 130 in the position shown in FIG. 2. The result is a predetermined burst of fire or continuous fire, respectively. The actuating arm 136 bearing the control roller 142 on the trigger lever 130 acts as a primary actuation input, which is independent of the breech block, for the kinematic chain represented by the lever and spring arrangement for placing the catch lever 100 into the "fire" position shown in FIG. 2.

To interrupt firing, a corresponding actuation movement is fed into the primary actuation input of the kinematic chain in that the trigger table on the gun mount side is released to cause the trigger lever 130 to return to its starting position under the force of the trigger spring 88. The control tongue 156 at the upper arm 154 of the trigger lever 130 now releases the control abutment 117 at the catch lever 100. Under the force of the catch spring 84, the catch lever 100 is pivoted counterclockwise and thus its control tongue 118 comes against a detent face 203 of holding tongue 202 of holding lever 180, which face holds the catch lever 100 in the intermediate position shown in FIG. 3 in such a manner that the upper face 108, in the form of a control face, projects into the path of movement M of block 2. The tongue 218 of the release lever 210 also enters the path of movement M so that as a whole a state results as shown in FIG. 3.

The breech block 2, whose return movement is in the direction M2, presses, in a frontal region of the inclined control face 14, which is not identified in detail, and thereafter in a region of the underside 10, against the upper side control face 108 of the catch lever 100 and pivots it clockwise back into the housing 20. During the further return movement of the breech block 2 in direction M2, there finally results the state shown in FIG. 4.

Due to the fact that the control face 14 and finally the underside 10 of the breech block 2 abut on tongue 218 of the release lever 210, the holding lever 180 is deflected counterclockwise so that the detent face 203 goes out of contact with the control tongue 118 of the catch lever 100. Due to the concave surface 120 of the catch lever 100 the catch lever is allowed to move clockwise in respect to the lower setting lever 162. As soon as, during the further return movement of the breech block 2 in the direction M2, the lower edge 8 of the catch shoulder 6 has moved past the catch lever 100, the latter is driven, under the force of the catch spring 84, fully into the catch position shown in FIG. 1.

As soon as the breech block 2, after its reversal of movement, advances again in the forward direction M1 under the force of the locking spring arrangement, its catch shoulder 6 abuts fully on the catch face 104 of the catch lever 100. The kinetic energy, or momentum, thus dissipated by the breech block 2 leads to an axial movement of the housing 20 in the direction M1 during which the control tongue 74 of the control bolt 68 is flung against the already mentioned face 74' of the weapon housing so that the active face 78 of the control bolt 68 is quickly moved against the underside face 112 of the catch lever 100 and thus counteracts the impact of block 2 on the catch lever 100. The path over which the control bolt 68 can move upwardly from its starting position shown in FIG. 1 is defined by a recess 80 in bolt 68 cooperating with a holding pin 82 fixed to housing 20.

As can be seen from the above description, the trigger lever 130 again acts as the primary actuation input. Due to its return movement, the catch lever 100 not only reaches its intermediate position shown in FIG. 3, but the tongue 218 of the release lever 210 also enters into the path of movement M of the breech block 2. The catch lever 100 as well as the release lever 210 in this way form a secondary actuation input which is activated by the trigger lever 130, providing the primary actuation input, and is dependent on the breech block.

As appears from the above description, the catch lever 100 can be moved into the path of movement M of the breech block 2 only if the latter, after it has passed over the trigger device in the direction M2, has reversed its movement to the direction M1 and the secondary actuation input has been activated in time. Otherwise, the breech block 2 passes over the trigger device with the catch lever 100 in the intermediate position shown in FIG. 3. The latter can be freed from its intermediate position only by a counterclockwise deflection of the holding lever 180 as shown in FIG. 4.

The articulated connection of the lower setting lever 162 to the trigger lever 130 results, in an advantageous manner, in a structure in this region which is simple and effective. A reliable recoil protection for the catch lever 100 is advantageously assured by the arrangement of the housing 20 so that it can move in the axial direction.

It will be understood that the above description of the present invention is susceptible to various modifications, changes and adaptations, and the same are intended to be comprehended within the meaning and range of equivalents of the appended claims.

We claim:

1. In a trigger device for an automatic firearm equipped with a linearly displaceable breech block provided with a catch shoulder and a control face arranged to cooperate with the trigger device, the trigger device including a housing, and means defining a kinematic chain provided with a primary actuation input and a secondary actuation input, the kinematic chain including a release lever arranged to be movable between a retracted position in which it is clear of the path of movement of the control face and an actuating position in which it can be displaced by the control face to provide at least part of the secondary actuation input, a catch lever constituting the output of the chain and movable between a catch position in which it can engage the catch shoulder and a retracted position in which it permits free linear displacement of the breech block, a trigger lever movable between an inactive position and a firing position and having a plurality of arms, with a first one of the arms providing the primary actuating input for the chain and being arranged to be acted upon by a trigger table for moving the trigger lever from its inactive position to its firing position, a trigger spring associated with the trigger lever for urging it into its inactive position, with the first arm projecting out of the housing, a lower setting lever arranged to cooperate with the trigger lever, a first reset spring associated with the lower setting lever for urging it into a reference position, and means defining pivot bearings for pivotal movement of the release lever, catch lever, trigger lever and lower setting lever about axes transverse to the direction of linear displacement of the breech block, with the pivot bearing for the release lever being movable relative to the housing, the release lever being movable into its retracted position in response to movement of the trigger lever into its firing position and being movable into its actuating position in response to movement of the trigger lever into its inactive position, and the kinematic chain being operative for moving the catch lever into its retracted position exclusively by movement of the trigger lever into its firing position and for permitting the catch lever to move from its retracted position into its catch position upon return of the trigger lever into its inactive position and subsequent actuation of the release lever by the breech block control face, the improvement wherein:

said chain further comprises a holding lever mounted in the housing for pivotal movement about an axis transverse to the direction of linear displacement of the breech block and carrying the pivot bearing for said release lever, a holding spring associated with said holding lever for urging it into a normal position, and a second reset spring associated with said release lever for urging said release lever into its actuating position;

said release lever is provided with a control projection and said trigger lever is provided with a control cam disposed for cooperating with said control projection for moving said release lever into its retracted position in response to movement of said trigger lever into its firing position;

said holding lever presents a tongue positioned for engaging said catch lever and arresting said catch lever in a first intermediate position between its said catch position and retracted position during movement of said catch lever from its retracted position at a time when said holding lever is in its normal position;

said catch lever is provided, at the end thereof remote from its associated pivot bearing, with a concave face disposed for effecting a deflecting contact with said lower setting lever when said catch lever is in a second intermediate position between its said catch position and retracted position; and said release lever is operatively associated with said holding lever such that displacement of said release lever by the breech block control face moves said holding lever away from its normal position to an extent sufficient to move said holding lever tongue out of a position in which it can engage said catch lever, to release said catch lever from its first intermediate position.

2. A device as defined in claim 1 wherein said pivot bearing for said lower setting lever is carried by a second arm of said trigger lever.

3. A device as defined in claim 1 or 2 wherein:

said housing is releasably connectable to a housing of the firearm and is axially movable against the force of a spring;

said device further comprises a control bolt provided with a control tongue facing out of said housing and an active face facing into said housing toward a lateral edge of said catch lever, and displaceably mounted in said housing for causing such axial movement of said housing to bring said bolt control tongue into engagement with the firearm housing in a manner resulting in movement of said active face toward said catch lever lateral edge.

4. A device as defined in claim 1 or 2 further comprising a catch lever spring operatively associated with said catch lever for urging it into its catch position.

* * * * *